United States Patent [19]

Hintsch

[11] Patent Number: 4,669,512

[45] Date of Patent: Jun. 2, 1987

[54] BRAKE FOR A PROJECTILE IN A WEAVING MACHINE

[75] Inventor: Otto Hintsch, Wallisellen, Switzerland

[73] Assignee: Sulzer Brothers Limited, Winterthur, Switzerland

[21] Appl. No.: 814,196

[22] Filed: Dec. 27, 1985

[30] Foreign Application Priority Data

Jan. 28, 1985 [EP] European Pat. Off. ..... 85100854.0

[51] Int. Cl.[4] ..... D03D 45/54

[52] U.S. Cl. ..... 139/185

[58] Field of Search ..... 139/439, 438, 185, 186, 139/187

[56] References Cited

U.S. PATENT DOCUMENTS

| | | | |
|---|---|---|---|
| 2,271,205 | 1/1942 | Pfarrwaller | 139/187 |
| 2,755,825 | 7/1956 | Deventer | 139/185 |
| 2,956,591 | 10/1960 | Sherwood | 139/185 |
| 3,865,150 | 2/1975 | Demuth | 139/185 |

*Primary Examiner*—Henry S. Jaudon

*Attorney, Agent, or Firm*—Kenyon & Kenyon

[57] ABSTRACT

The projectile brake has two brake shoes movable relative to one another. The brake shoe carriers engage with spring pressure on either side of a wedge which is movable transversely to the application and release directions of movement of the brake shoes. When the wedge moves, the two brake shoe carriers move in opposite directions to one another; the two shoes move over the same distance relative to one another so that the longitudinal axis of the braking channel is always in alignment with the path of the projectile entering from the guide channel despite wear of the brake linings.

13 Claims, 11 Drawing Figures

BRAKE FOR A PROJECTILE IN A WEAVING MACHINE

This invention relates to a brake for a projectile in a weaving machine.

As is known, weaving machines are frequently provided with a brake on a catching side in order to brake a picked projectile to a stop.

Generally, the brake is constructed of a pair of brake shoes each of which has a suitable brake lining to engage the projectile. If the stop or stationary position of the projectiles is to remain within a permissible range, the brake requires regular readjustment due to the unavoidable wear of the brake linings. Usually, the upper brake shoe can be adjusted for this purpose. However, one disadvantage of this is that the longitudinal axis of the braking channel formed between the brake shoes becomes shifted relative to the longitudinal axis of the guiding channel from which the projectile is delivered into the brake. Consequently, the projectile tilts when leaving the guide channel and entering the brake. The projectile therefore performs a movement similar to the rolling movement of a ship and the stationary position of the projectile, after braking, is not always a straight position.

Further, where an ejector is used to press a projectile into an ejection position, should the projectile be out of line, the ejector will strike the skewed projectile. Thus, the projectile is actuated one sidedly and the yarn clamp of the projectile oscillates transversely. This transverse oscillation, in turn, causes the clamping surfaces of the yarn clamp to rub on each otherwith a result that the weft yarn either slips out of the clamp or is abraded away therein. In both cases, the result in unsatisfactory picking of the weft yarn.

Accordingly, it is an object of the invention to provide a projectile brake in which the longitudinal axis of the braking channel remains in registration with the longitudinal axis of the projectile guiding channel despite wear of the brake linings of the brake.

It is another object of the invention to maintain the brake shoes of a projectile brake in line with a guide channel from which a projectile is delivered.

It is another object of the invention to provide a relatively simple construction for ensuring alignment of a braking channel with a projectile guide channel in a weaving machine.

Briefly, the invention provides a projectile brake for a weaving machine which is comprised of a pair of moveable brake shoes which are disposed in spaced facing relation to each other in order to brake a projectile along a longitudinal axis of a braking channel defined therebetween and means for simultaneously moving the brake shoes towards and away from each other relative to the axis of the braking channel. In this regard, the brake shoes can be moved simultaneously toward or away from each other during a readjustment so that the axis of the braking channel defined by the shoes remains in a constant position. Thus, the axis of the braking channel can be maintained in registry, i.e. alignment, with a guide channel through which a projectile is picked into the brake.

In one embodiment, each of the brake shoes is secured to a reciprocable carrier while the means for simultaneously moving the brake shoes includes a wedge disoosed between respective ends of the carriers in order to effect opposite movements of the carriers.

In another embodiment, a spindle having a portion of oval cross-section can be used to move the carriers connected to the brake shoes in opposite directions.

In still another embodiment, a spindle having eccentric disks can be used to move the carriers connected to the brake shoes in opposite directions.

In still another embodiment, a rotatable spindle having oppositely directed screw threads can be used to drive the carriers connected to the brake shoes in opposite directions.

These and other objects and advantages of the invention will become more apparent from the following detailed description taken in conjunction with the accompanying drawings wherein:

FIG. 1 illustrates a front view of a projectile brake constructed in accordance with the invention and taken in the direction of arrow II of FIG. 2;

FIG. 1*a* illustrates a side view of a spring-biased connection between a slider and a carrier in accordance with the invention;

Figures 1, 2:
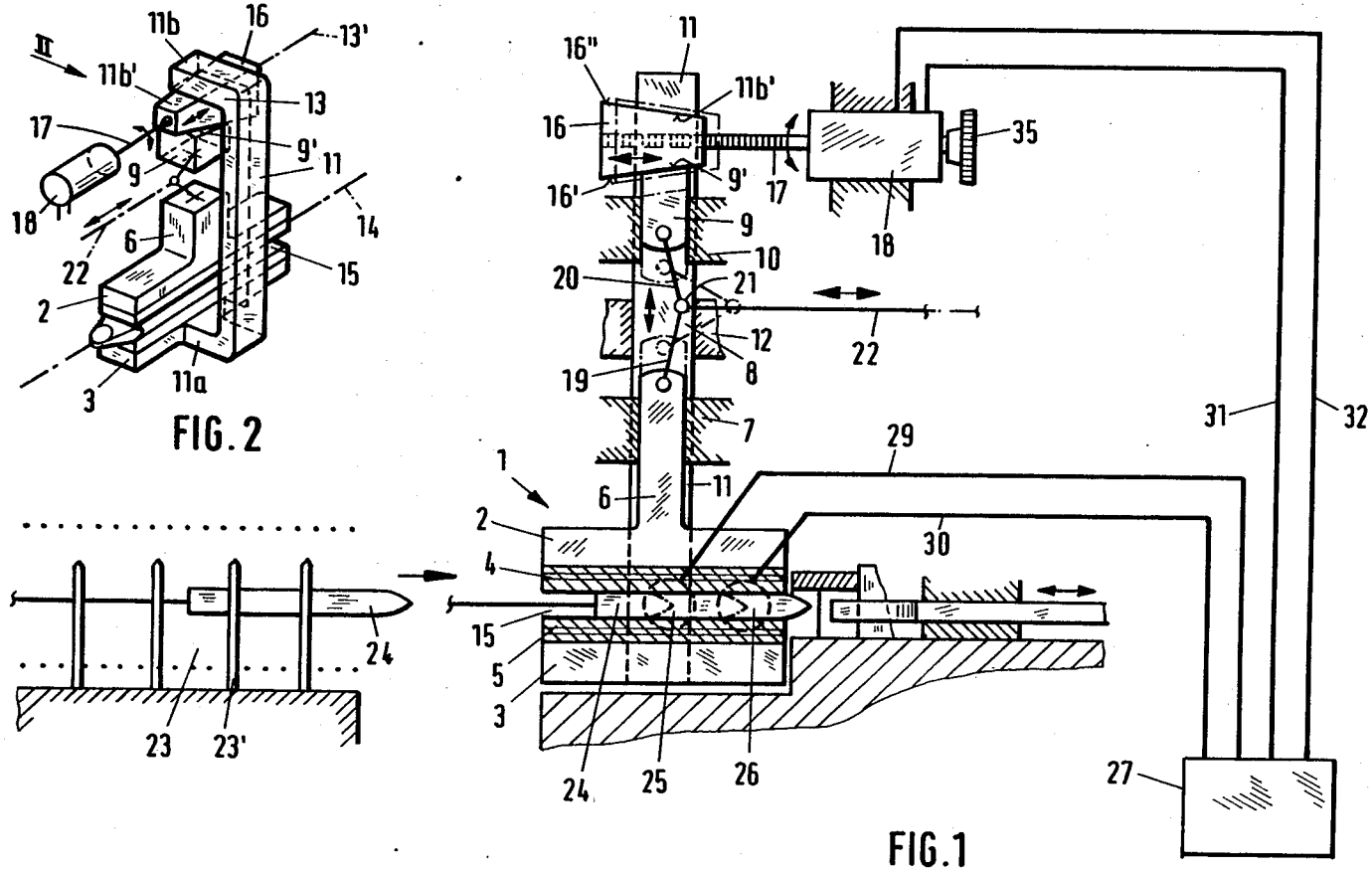
FIG. 2 illustrates a perspective view of a part of the brake of FIG. 1 in accordance with the invention.

Referring to FIG. 1, the projectile brake 1 is provided with a pair of moveable brake shoes 2, 3 each of which is provided with a brake lining 4, 5, respectively. As indicated, the brake shoes 2, 3 are disposed in spaced facing relation to each other in order to brake a projectile 24 along a longitudinal axis 14 (see FIG. 2) of a braking channel 15.

Referring to FIGS. 1 and 2, the top shoe 2 is integrally connected with a carrier 6 which is adapted to reciprocate vertically in a guide 7 of the weaving machine. In addition, the carrier 6 is connected by a linkage 8 to a slider 9 which is adapted to reciprocate vertically in a second guide 10 of the weaving machine. The upper end of the slider 9, as viewed, is provided with an inclined end face 9'.

The bottom shoe 3 is integrally connected with a carrier 11 which is adapted to reciprocate vertically in a further guide 12 of the weaving machine. As indicated in FIG. 2, the carrier 11 has a pair of angled parts 11*a*, 11*b* which bridge the shoe carrier 6 of the top shoe 2. The lower surface 11*b'* of the part 11*b* of the carrier 11 is inclined opposite to the inclination of the face 9' of the slider 9.

As indicated in FIG. 1, the inclined end face 9' of the slider and the oppositely inclined end face 11*b'* cooperate to bound a wedge-shaped space 13 having a longitudinal axis 13' which extends parallel to the longitudinal axis 14 of the braking channel 15.

Figure 1A:
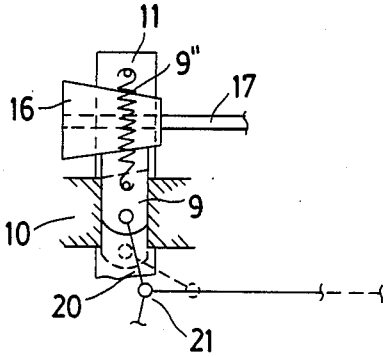

A means in the form of an adjusting or displacement member, i.e. a wedge 16, is provided for simultaneously moving the brake shoes 2, 3 via the slider 9 and articulated carrier 6 and the carrier 11, respectively, towards and away from each other and the longitudinal axis 14 of the braking channel 15. As indicated, the wedge 16 has a threaded spindle 17 threaded therethrough while a servomotor 18 is provided for rotating the spindle 17 in order to move the wedge 16 relative to the slider 9 and carrier 11. In addition, as illustrated in FIG. 1*a*, a spring 9'' is provided to press the slider 9 and the carrier 11 into engagement with the wedge 16. The spring 9'' is secured at the lower end to the slider 9 in suitable manner while being secured at the upper end to the carrier 11 in suitable manner.

The number of revolutions of the servomotor 18 determines how far the wedge 16 moves to the right of to the left, that is, how far the slider 9 and carrier 11 are pressed apart from one another.

Referring to FIG. 1, the linkage 8 between the slider 9 and carrier 6 is composed of two levers 19, 21 which are connected by way of an articulation 21 to each other and to a machine-actuated brake lever 22 which is adapted to apply and release the brake 1 e.g. as described in U.S. Pat. Nos. 2,538,798 and 3,865,150. For braking, the lever 22 is moved to the left, as viewed, so that the carrier 6 with the shoe 2 moves towards the bottom shoe 3 with the slider 9 bearing on the wedge 16.

As also indicated in FIG. 1, the projectile 24 passes from a guide channel 23 formed by guide teeth 23' on a sley toward the brake 1.

The brake 1 is also provided with a pair of sensors 25, 26 and a control device 27. The sensors 25, 26 are disposed along the braking path of the projectile 24 and are connected via respective lines 29, 30 to the control device 27. The output of the control device 27 is connected via lines 31, 32 to the servomotor 15. Depending upon the braking, that is, upon the depth of penetration of a projectile 28 between the brake shoes 2, 3, the control device 27 forms an appropriate signal for the servomotor 15 to adjust the wedge 11. For example, if the projectile 24 does not enter the brake far enough, that is, if braking is excessive, the sensor 25 delivers a signal via the line 29 to the control device 27 so that a signal can be delivered via the line 31 to the servomotor 18 in order to move the wedge 16 to the left and a little out of the space 13 between the slider 9 and the carrier 11. The slider 9 thus moves upwardly under the bias of the spring (not shown) while the carrier 11 descends. By way of the levers 19, 20, the slider 9 produces a corresponding uowards movement of the carrier 6 with the top brake shoe 2. At the same time , the carrier 11 lowers the bottom brake shoe 3 correspondingly. The distance between the brake shoes 2, 3 therefore increases. When the brake 1 is subsequently applied by the brake lever 2, braking is correspondingly less so that the projectile 24 penetrates further into the brake 1.

If the projectile 24 penetrates too far into the brake, that is, braking is adequate, the sensor 26 emits a signal via the line 30 to the control device 27 which, in turn, delivers a signal via the line 32 to the servomotor 18 to draw the wedge 16 to the right and, therefore, further into the space 13. As a result, the slider 9 descends and the carrier 11 rises so that the brake shoes 2, 3 are moved towards one another. Thus, when the lever 22 applies the brake, the braking action provided is greater.

Since the brake shoes 2, 3 move over the same distance in relation to one another in the case of both adjustments, the longitudinal axis 14 of the brake channel 15 is always in registration with the path of the projectile 24 entering from the guide channel 23 despite wear of the brake linings 4, 5.

As indicated in FIG. 1, the servomotor 18 has a manual controller 35 for setting the initial position of the wedge 6 and, therefore, the initial position of the slider 9 and carrier 11.

Figure 3:
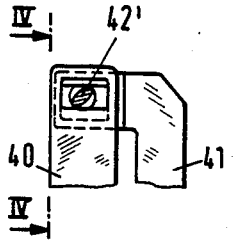
FIG. 3 illustrates a front view of a part of a modified arrangement employing a spindle with a portion of oval cross-section for moving the carriers attached to the brake shoes of a brake in accordance with the invention.
Figure 4:
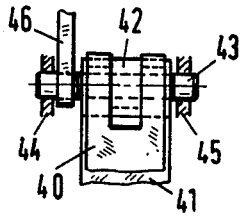
FIG. 4 illustrates a view taken on line IV—IV of FIG. 3.
Figure 5:
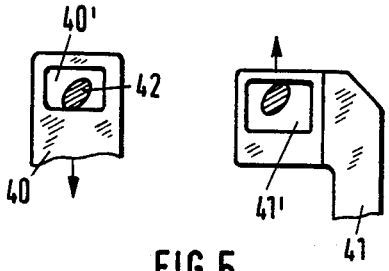
FIG. 5 is a diagrammatic illustration to explain the operation of the spindle of FIG. 3.

Referrings to FIGS. 3, 4 and 5, the slider 40 (or carrier) which is connected to the top brake shoe and the carrier 41 which is connected to the bottom brake shoe may be actuated by a displacement member in the form of a spindle 43 having a a portion 42 of oval cross-section 42'. In this case, the spindle or carrier 40 secured to the top brake shoe is formed with a rectangular aperture 40' while the carrier 41 for the bottom brake shoe is formed with a rectangular aperture 41'. As indicated in FIG. 5, the portion 42 of the spindle 43 is disposed in each aperture 40', 41' so that upon rotation of the spindle, the carriers 40, 41 move in opposite directions.

Referring to FIG. 4, the spindle 43 is rotatably mounted in suitable bearings 44, 45 of the weaving machine while a lever 46 which is connected to a servomotor (not shown) is connected to the spindle 43 in order to oscillate the spindle 43.

In order to adjust the braking effect of the brake, the lever 46 is pivoted to turn the spindle portion 42 one way or the other to thus vary the spacing between the slider (or carrier) 40 and the carrier 41 in a similar fashion to that as described with respect to FIG. 1.

Figure 6:
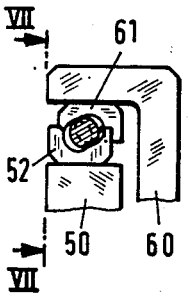
FIG. 6 illustrates a front view of a modified adjusting member employing a spindle with eccentric disks in accordance with the invention.
Figure 7:
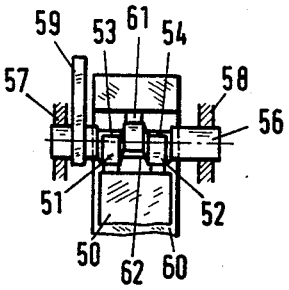
FIG. 7 illustrates a view taken on line VII—VII of FIG. 6.

Referring to FIGS. 6 and 7, the slider 50 or the top brake shoe may be provided with a pair of half-bearings 51, 52 while the carrier 60 for the bottom brake shoe has a half-bearing 61. The displacement member for adjusting the slider 50 and carrier 60 is in the form of a rotatable spindle 56 which is mounted in two bearings 57, 58 in the weaving machine and which carries eccentric portions 53, 54 which are received in the half-bearings 51, 52 and a third eccentric portion 62 which is received in the half-bearing 61. In addition, a lever 59 is secured to the spindle 56 to rotate or oscillate the spindle when required.

As indicated in FIG. 7, the eccentric portion 62 has an eccentricity which is oppositely directed to the eccentricity of the two eccentric portions 53, 54. Thus, upon movement of the lever 59, the spindle 56 is rotated so that the eccentricity of the respective disks 53, 54, 62 is varied and, likewise, the distance between the brake shoes.

Figure 8:
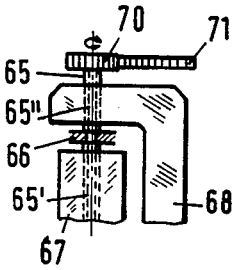
FIG. 8 illustrates a view of a modified arrangement employing a spindle having oppositely directed screw threads in accordance with the invention.
Figure 10:
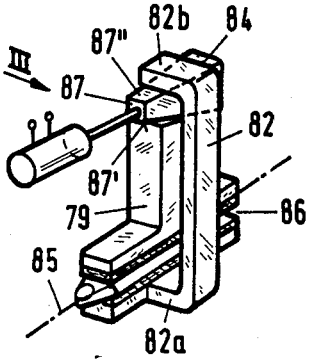
FIG. 10 illustrates a perspective view of a part of the brake of FIG. 9.

Referring to FIG. 8, the adjusting member may also be in the form of a rotatable spindle 65 which is rotatably mounted in a support 66 secured to the weaving machine with a first screw thread 65' threaded into the slider 67 and with a second oppositely directed screw thread 65'' threaded into the carrier 68 In addition a pinion 70 is secured on the spindle 65 and is rotated by a servomotor (not shown) via a rack or belt 71. Thus, upon rotation of the pinion 70 in one direction, the slider 67 and carrier 68 are moved together to effect a decrease in braking action while rotation in the opposite direction causes the slider 67 and carrier 68 to move apart and thus effect a greater braking action.

Figure 9:
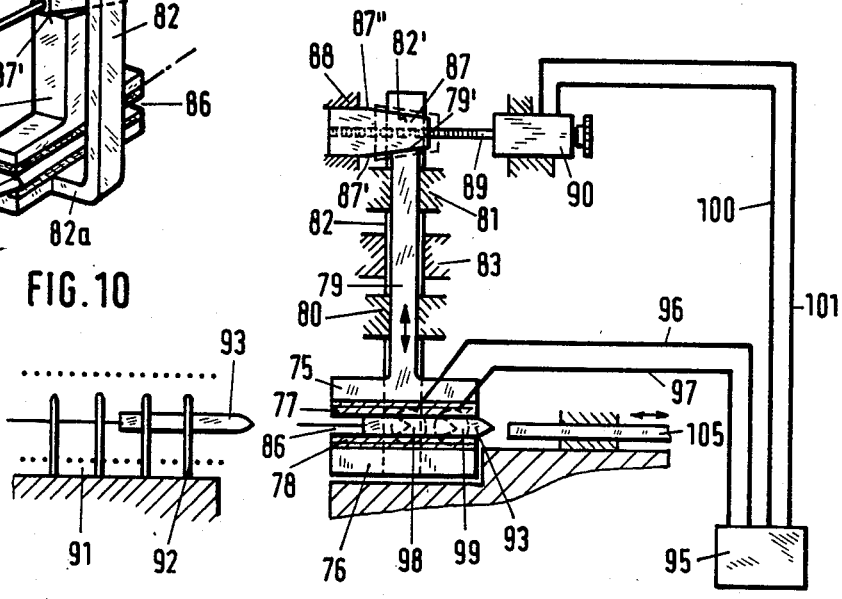
FIG. 9 illustrates a modified brake in accordance with the invention taken in the direction of arrow III—III of FIG. 10.

Referring to FIG. 9, the brake may be constructed so that the correction or adjustment of the braking is combined with the actual actuation of the brake. In this regard, the top brake shoe 75 which carries a brake lining 77 is integrally secured with a brake shoe carrier 79 which is adapted to reciprocate vertically in two guides 80, 81 of the lever machine. The bottom brake shoe 76 which carries a brake lining 78 is integrally connected with a shoe carrier 82 which is adapted to reciprocate vertically in a guide 83 of the weaving machine. In addition, the carrier 82 has a pair of angled members 82*a*, 82*b* which bridge the carrier 79 in a fashion similar to the carrier 11 of FIG. 2. In addition, the end face 79' of the carrier 79 and an opposite side 82' of the carrier 82 are bevelled and co-operate to bound a wedge-shaped 84 whose longitudinal axis extends parallel to the longitudinal axis 85 of the braking channel 86 disposed between the brake shoes 75, 76. A brake-actuating and adjusting member in the form of a wedge 87 so engages in the space 84 that one wedge surface 87' extends parallel to the inclined end face 79' of the shoe carrier 79 while another wedge surface 87'' extends parallel to inside surface 82' of shoe carrier 82. Springs (not shown) press the shoe carriers 79, 82 into engagement with the wedge 87.

The wedge 87 is guided at one end in a guide 88 of the weaving machine and has at its other end a screwthreaded rod 89 of a braking and servo motor 90. The number of revolutions thereof determines how far the wedge 87 is drawn to the left or to the right—i.e., how far the shoe carriers 79, 82 are displaced. A projectile 93 can be seen moving through a guide channel 91 from guide teeth 92 towards the brake.

The projectile brake is controlled by means of a control device 95. In a manner which will be described hereinafter, the control includes correction of braking with wear of the brake linings 77, 78 of the shoes 75, 76. The control device 95 is connected on an input side by way of lines 96, 97 to two detectors 98, 99 respectively disposed along the braking path of the projectile 93. The output of the control device 95 is connected by way of lines 100, 101 to the motor 90. In response to any braking signal from the device 95 to the motor 90, the motor 90 draws the wedge 98 to the right and into the space 84 between the two shoe carriers 79, 82. The carriers 79, 82 thus move apart from one another so that the carrier 79 descends and the carrier 82 rises. The shoes 75, 76 therefore move towards one another to engage on the projectile 93. Since the two shoes 75,76 move over the same distance relative to one another during braking, the longitudinal axis 85 of the braking channel 86 is always in registration with the path of the projectile 93 entering from the guide channel 91 despite wear of the brake linings 77, 78. After the projectile 93 has stopped and has been returned by an ejector 105, the control device 95 acts to make the motor 90 return the wedge 87 and, therefore, the two shoe carriers 79, 82 to their initial position so that the brake releases and the projectile can be ejected to a return conveyor.

If braking is excessive so that the projectile 93 does not penetrate far enough into the brake, the control device 95 produces a shorter signal for the motor 90 so that the wedge 87 does not penetrate so far between the shoe carriers 79, 82. The carriers 79, 82 are now pushed a little further apart from one another so that the two shoes 75, 76 are not so close to one another, so that braking is reduced. However, if the projectile 93 penetrates too far into the brake, i.e. if braking is inadequate, the control device 95 produces a longer signal for the motor 90 so that the wedge 87 penetrates further between the shoe carriers 79, 82 and the shoes 75, 76 move closer together and thus provide increasing braking.

The displacement members described with reference to FIGS. 3 to 8 can of course be used in the embodiment of FIG. 9 instead of the wedge 87.

The invention thus provides a brake for a weaving machine which can be readjusted from time to time in order to maintain the braking channel defined by the brake shoes in registry with the path of the projectile entering the brake.

The invention further provides a relatively simple structure for adjusting the brake shoes of a brake simultaneously to maintain a longitudinal axis of the braking channel in a constant position.

What is claimed is:

1. A projectile brake for a weaving machine comprising a first movable brake shoe;

a second movable brake shoe disposed in spaced facing relation to said first brake shoe to brake a projectile along a longitudinal axis of a braking channel therebetween;

a linkage including a machine actuated brake lever for moving one of said shoes toward the other shoe to brake a projectile therebetween; and means for simultaneous moving of said brake shoes towards and away from each other to adjust brake shoes relative to each other and to said axis while maintaining said axis in a constant position.

2. A projectile brake as set forth in claim 1 wherein said means includes a displacement member movable transversely of the direction of movement of said brake shoes.

3. A projectile brake as set forth in claim 2 which further includes a first reciprocally mounted carrier secured to said first brake shoe and a second reciprocally mounted carrier secured to said second brake shoe, said displacement member being a wedge having a pair of inclined surfaces disposed on opposite sides thereof and in sliding engagement with a respective carrier.

4. A projectile brake as set forth in claim 2 which further includes a first reciprocally mounted carrier secured to said first brake shoe and a second reciprocally mounted carrier secured to said second brake shoe, said displacement member being a rotatable spindle having an oval cross-sectional portion engaging each carrier to reciprocate each carrier in response to rotation of said spindle.

5. A projectile brake as set forth in claim 2 which further includes a first reciprocally mounted carrier secured to said first brake shoe and a second reciprocally mounted carrier secured to said second brake shoe, said displacement member including an eccentric disc mounted in each carrier for reciprocating each carrier in response to rotation of said discs.

6. A projectile brake as set forth in claim 2 which further includes a first reciprocally mounted carrier secured to said frist brake shoe and a second reciprocally mounted carrier secured to said second brake shoe, said displacement member including a rotatable spindle having a first screw thread threaded into one carrier and a second oppositely directed screw thread threaded into the other carrier.

7. A projectile brake for a weaving machine comprising a first movable brake shoe;

a second movable brake shoe disposed in spaced facing relation to said first brake shoe to brake a projectile along a longitudinal axis of a braking channel therebetween a linkage including a machine-actuated brake lever for moving one of said shoes toward the other shoe to brake a projectile therebetween;

a reciprocally mounted slider connected to said first shoe;

a reciprocally mounted carrier secured to said second shoe; and a movable adjusting member disposed in biased engagement with said slider and said carrier for simultaneously moving said slider and said carrier to effect a simultaneous movement of said brake shoes towards and away from each other to adjust said shoes relative to said axis while maintaining said axis in a constant position.

8. A projectile brake as set forth in claim 7 wherein said adjusting member is a wedge having a pair of inclined surfaces on opposite sides and in sliding engagement with each of said slider and said carrier.

9. A projectile brake as set forth in claim 8 which further includes a threaded spindle rotatably secured in said adjusting member and a servomotor for rotating said spindle to move said adjusting element relative to said slider.

10. A projectile brake as set forth in claim 9 which further includes at least one sensor adjacent said brake shoes to detect the presence of a braked projectile thereat and to emit a signal in response thereto, and a control device connected to and between said sensor and said servomotor to actuate said servomotor in response to a signal from said sensor to move said adjusting member in a predetermined direction.

11. A projectile brake as set forth in claim 7 wherein said adjusting member is a spindle having a portion of oval cross-section engaging each of said slider and said carrier to reciprocate each of said slider and carrier in opposite directions upon rotation of said spindle.

12. A projectile brake as set forth in claim 7 wherein said adjusting member is a spindle including one eccentric disc in said slider and a second eccentric disc in said carrier to reciprocate each of said slider and carrier in opposite directions upon rotation of said spindle.

13. A projectile brake as set forth in claim 7 wherein said adjusting member includes a rotatable spindle having a first screw thread threaded into said slider and a second oppositely directed screw thread threaded into said carrier.

* * * * *

UNITED STATES PATENT AND TRADEMARK OFFICE

CERTIFICATE OF CORRECTION

PATENT NO. : 4,669,512

DATED : June 2, 1987

INVENTOR(S) : Otto Hintsch

It is certified that error appears in the above-identified patent and that said Letters Patent is hereby corrected as shown below:

Column 1, line 33 "otherwith" should be -other with-
Column 1, line 35 "in" should be -is-
Column 1, line 67 "disoosed" should be -disposed-
Column 3, line 20 "of" should be -or-
Column 3, line 55 "uowards" should be -upwards-
Column 3, line 63 "adequate" should be -inadequate-
Column 5, line 14 after "shaped" insert -space-
Column 6, line 60 "frist" should be -first-

Signed and Sealed this

First Day of December, 1987

*Attest:*

DONALD J. QUIGG

*Attesting Officer*

*Commissioner of Patents and Trademarks*